United States Patent [19]

Chen

[11] Patent Number: 5,054,780

[45] Date of Patent: Oct. 8, 1991

[54] WEIGHT ADJUSTABLE TENNIS RACQUET

[76] Inventor: Dennis Chen, 293 Pei Tun Road, Taichung, Taiwan

[21] Appl. No.: 575,389

[22] Filed: Aug. 30, 1990

[51] Int. Cl.[5] ..... A63B 49/04

[52] U.S. Cl. ..... 273/73 R; 273/73 C

[58] Field of Search ..... 273/73 R, 73 C, 73 D, 273/73 E, 73 F, 73 G, 73 H, 73 L

[56] References Cited

U.S. PATENT DOCUMENTS

| | | | |
|---|---|---|---|
| 3,913,911 | 10/1975 | Peterson | 273/73 C |
| 4,192,505 | 3/1980 | Tabickman et al. | 273/73 C |
| 4,353,551 | 10/1982 | Arieh et al. | 273/73 C |
| 4,693,474 | 9/1987 | Glaessgen et al. | 273/73 D |
| 4,697,811 | 10/1987 | Muroi | 273/73 C |

FOREIGN PATENT DOCUMENTS

| | | | |
|---|---|---|---|
| 0201953 | 11/1986 | European Pat. Off. | 273/73 C |

*Primary Examiner*—Edward M. Coven

*Assistant Examiner*—Raleigh W. Chiu

[57] ABSTRACT

A weight adjustable tennis racquet comprises a head frame and a handle, wherein, at least one elastic counter-weight holder with a plurality of counter weights can be attached to the head frame. At least one receiving recess is formed on the head frame along with a retaining bar extending across the width of each recess to conform with the profile of the head frame. Each counter-weight holder has a cavity formed on its inner surface and a retaining groove formed on its outer surface. A plurality of circular recesses is formed on the base of each retaining groove receive a variable number of counter weights for weight adjustment. The elastic counter-weight holders with the selective addition of counter weights, can be inserted into the receiving recesses with their cavities gripping the inner circumference of the head frame and the retaining bars in place over the retaining grooves, holding the counter-weight holders and counter weights in place.

1 Claim, 2 Drawing Sheets

WEIGHT ADJUSTABLE TENNIS RACQUET

BACKGROUND OF THE PRESENT INVENTION

The present invention relates to a tennis racket and more particularly to a weight adjustable tennis racquet.

A tennis player after a long period of play may, due to fatigue, require a lighter racquet to maintain control. As such, the need arises for a weight-adjustable racquet.

In U.S. Pat. No. 1,587,918, by Morrison, is provided a racquet incorporating a movable weight, positionable within a hollow cavity in the handle, whereby the weight can be moved to and fro along the axis of the handle. Although this method enables adjustment of the racquets center of gravity, the weight of the racquet is not changed.

In the racquet of the present invention the weight of the racquet can be incrementally changed by the addition of steel counter-weights to a pair of counter-weight carriers.

SUMMARY OF THE PRESENT INVENTION

The present invention has as a first object to provide a tennis racquet that is weight adjustable and as a second object a tennis racquet that absorbs shock.

The weight adjustable tennis racquet comprises a head frame and a handle, wherein, a pair of elastic counter-weight holders, with a plurality of steel balls acting as counter weights, can be attached to the head frame. A pair of receiving recesses are formed on the lateral sides of the head frame along with a retaining bar extending across the width of each recess at a distance away from the inner surface thereof. The pair of arcuate counter-weight holders have an oval cavity formed on their inner surfaces and a retaining groove formed on their outer surfaces. A plurality of circular recesses formed on the bases of the retaining grooves receive a variable number of steel counter weights for weight adjustment. Whereby, the elastic counter-weight holders with the selective addition of steel counter weights, can be inserted into the receiving recesses with their oval cavities gripping the inner walls of the receiving recesses and the retaining bars in place over the retaining grooves, holding the counter-weight holders and counter weights in place, achieving the first object of the present invention.

The elastic counter-weight holder being in contact with the head frame also absorbs shock generated in the head frame when a ball is violently struck, thereby accomplishing the second object of the present invention.

The invention is hereinafter described with reference to the accompanying drawings in which.

DESCRIPTION OF THE PRESENT INVENTION

Figure 1:
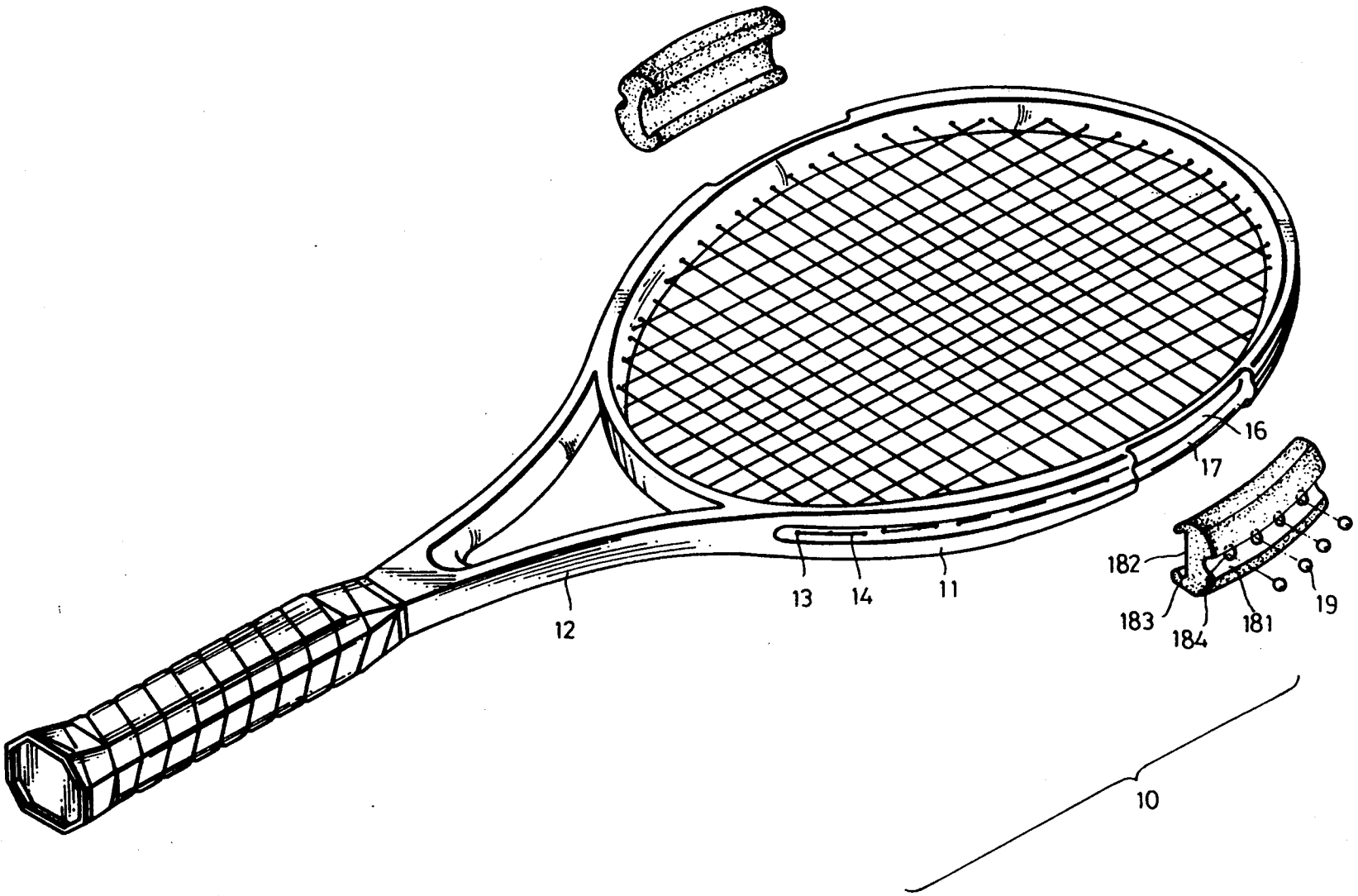
FIG. 1 is a fragmentary view of an embodiment of the weight adjustable tennis racquet.

Referring to FIG. 1, the weight adjustable tennis racquet 10 of the present invention includes an oval head frame 11, on whose periphery is formed a plurality of thru holes 13, a handle 12 extending from the head frame 11, and a net formed from a catgut string 15, threaded through the thru holes 13 in a criss-crossing manner.

The head frame 11 has two counter-weight recesses 16 located laterally in the plane of the center of percussion of the racquet, one at each side of the head frame 11 on its outer periphery. A retaining bar 17, of circular cross-section, extends across the counter-weight recess 16, a distance away from the wall thereof and conforming with the general profile of the head frame 11.

An arcuate counter-weight holder 18, made of an elastic material, has a length and profile substantially matching that of the counter-weight recess 16. A reentrant cavity 182 of oval cross-section is formed on the inner side of the counter-weight holder 18. The convex outer side of the counter-weight holder 18 has a retaining groove 181 of semi-circular cross-section extending across its length in a medial position. At the base of the retaining grooves 181 is formed a plurality of circular recesses 184, of similar diameter and depth as steel counter weights 19, which are in the form of steel spheres.

Figures 2, 3:
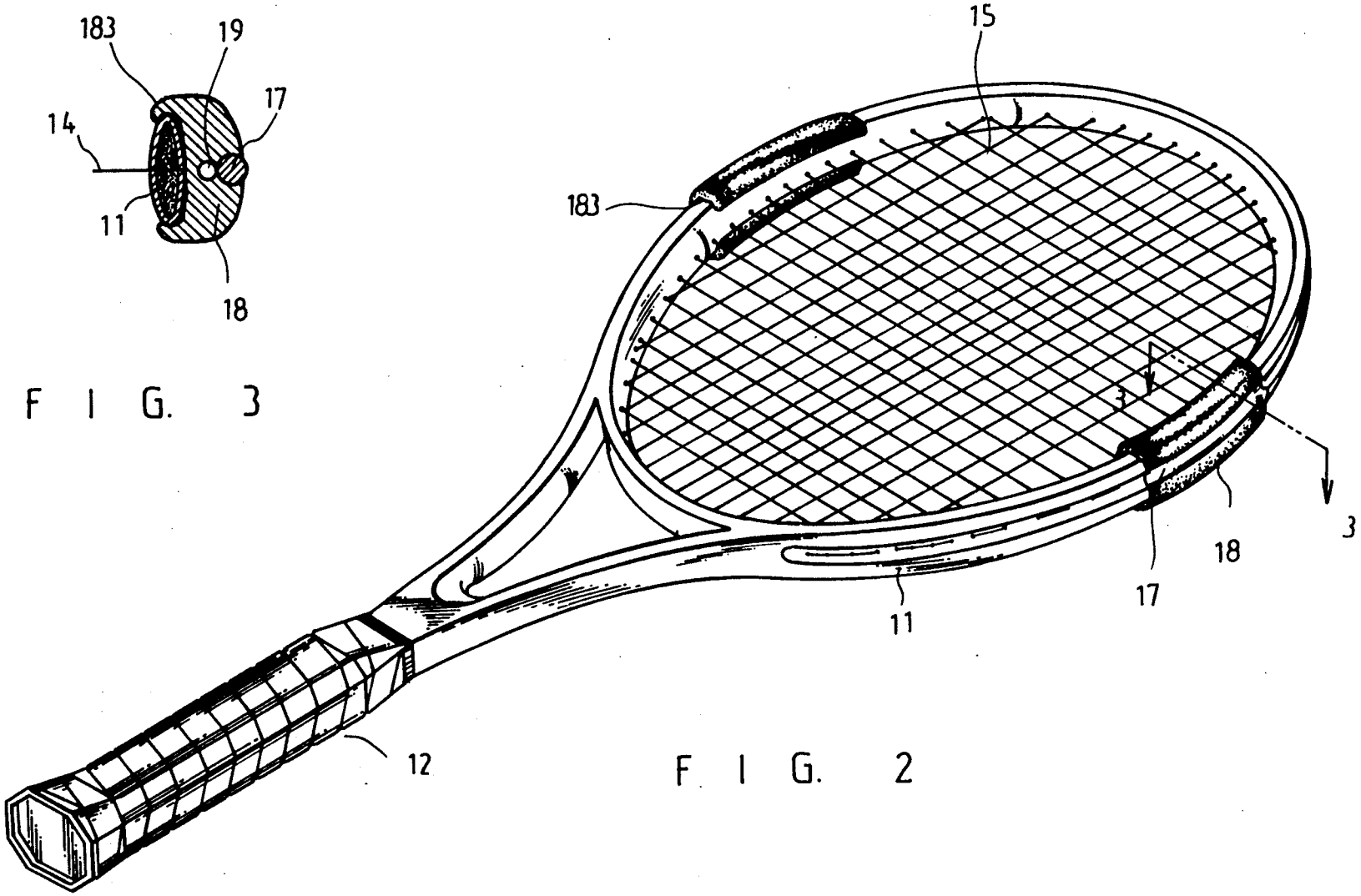
FIG. 2 is an assembled view of FIG. 1.
FIG. 3 is a cross-sectional view of an attached counter-weight taken from line 3—3 of FIG. 2.

Referring to FIGS. 1 and 3, an elastic counter-weight holder 18 is insertable into each counter-weight recess 16, the inner wall of each counter-weight recess 16 being enclosed over a majority of its surface by the reentrant cavity 182 with a pair of lips 183 thereon gripping the inner rim of the head frame 11. The retaining groove 181, likewise, encircles the inner side of retaining bar 17, trapping steel counter-weights 19 within circular recesses 184.

By varying the number and position of steel counter weights 19 within the counter-weight holder 18, the weight and balance of the racquet 10 can be adjusted to suit individual needs.

Moreover, shock generated in the head frame when a ball is violently struck is significantly absorbed by the resilient counter-weight holder 18 which is in intimate contact with a substantial portion of head frame 11.

Further modifications of the invention herein described will occur to persons skilled in the art and all such modifications are deemed to be within the scope of the invention as defined by the appended claims.

I claim:

1. A weight adjustable tennis racquet comprising a head frame, a net defined by a string threaded through a plurality of thru holes in a criss-crossing manner, and a handle extending from said head frame; said head frame comprising an inner circumference, an outer circumference, on which at least one counter-weight recess is formed for at least one resilient counter-weight holder securingly inserted to said counter-weight recess at a position corresponding to the transverse axis extending through the center of percussion of said racquet; an elongate retaining bar extending across said counter-weight recess to conform with the general profile of said head frame;

said counter-weight holder including an inner side, on which a reentrant cavity is formed, and an outer side, on which a semi-circular retaining groove is formed; a pair of lips extending slightly outwards from said inner side of said reentrant cavity for gripping said inner circumference of said head frame; a plurality of counter weights is in the form of steel spheres; said retaining groove has a base, on which a plurality of circular recesses are formed; said circular recesses have a depth and diameter similar to the diameter of said steel spheres;

whereby, said counter-weight holder is secured to said head frame by enveloping said counter-weight recess with said pair of lips on said reentrant cavity gripping said inner rim of said head frame and said retaining groove engages and envelops said retaining bar; said steel spheres can be selectively positioned among and within said circular recesses and secured in place by said retaining bar upon insertion of said counter-weight holder into said counter-weight recess, to adjust the weight and balance of said racquet.

* * * * *